US005152465A

United States Patent [19]

Calabro

[11] Patent Number: 5,152,465

[45] Date of Patent: Oct. 6, 1992

[54] SHOWER FLOW CONTROLLER

[76] Inventor: Daniel J. Calabro, 6657 Bothwell Rd., Reseda, Calif. 91335

[21] Appl. No.: 712,735

[22] Filed: Jun. 10, 1991

[51] Int. Cl.[5] ..... B05B 1/30

[52] U.S. Cl. ..... 239/578; 239/586; 251/117

[58] Field of Search ..... 239/569, 578, 583, 586; 251/117

[56] References Cited

U.S. PATENT DOCUMENTS 1,156,165 10/1915 McManamy et al. ..... 251/117
2,102,856 12/1937 Russell ..... 251/117
2,525,709 10/1950 Morrison ..... 251/117
3,065,917 11/1962 Fraser ..... 239/583

*Primary Examiner*—Andres Kashnikow
*Assistant Examiner*—Karen B. Merritt
*Attorney, Agent, or Firm*—Allan M. Shapiro

[57] ABSTRACT

The shower flow controller attaches on the shower arm, and the shower nozzle attaches thereto. The flow controller has a first orifice which is adjustable from within the body of the flow controller for minimal shower flow. The flow controller also has a second orifice which can be manually opened against a spring for bursts of additional water flow for rinse-off or the like. The second orifice is normally larger and is normally closed by spring force.

19 Claims, 1 Drawing Sheet

FIG. 1
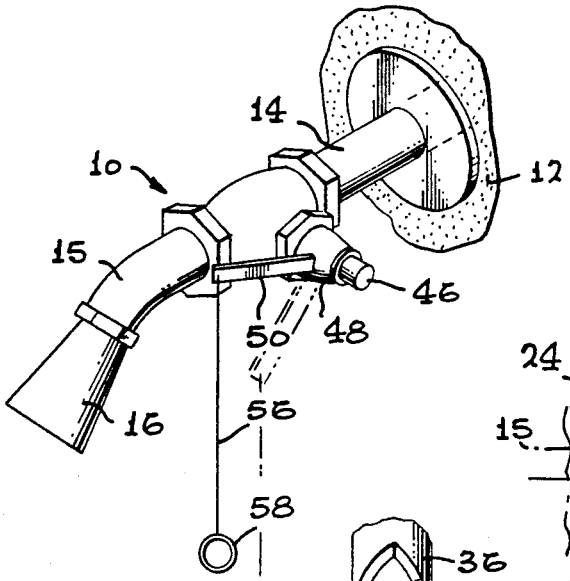
FIG. 2
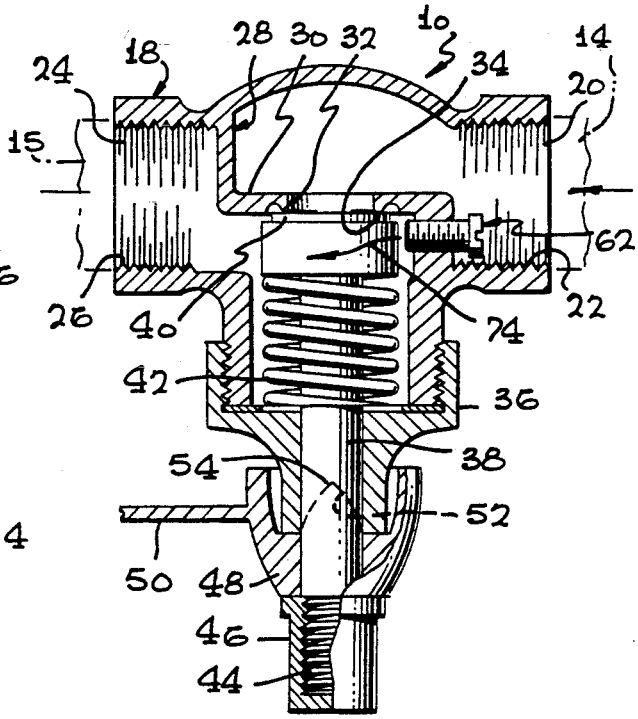
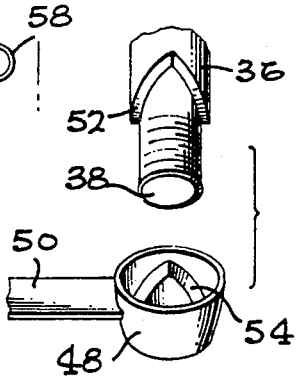
FIG. 5
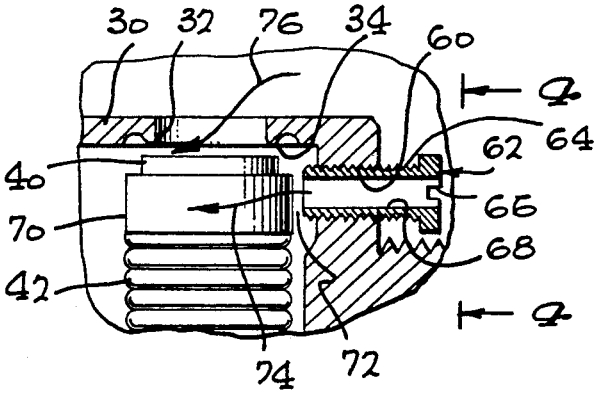
FIG. 3
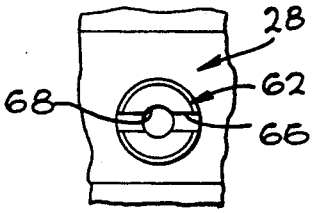
FIG. 4

SHOWER FLOW CONTROLLER

FIELD OF THE INVENTION

This invention is directed to a shower flow controller wherein a minimal shower flow is provided by a first orifice which is adjustable within the flow controller body, and larger flow is provided by manually opening a normally closed spring-closed valve.

BACKGROUND OF THE INVENTION

The use of showers in personal hygiene is widespread in the United States and a pleasure to most users. In a shower, the water is normally continuously running and the result is excess consumption. Thus, showers provide a major opportunity in water conservation. Fixed-rate low-flow showerheads are well known. However, some users find these low-flow showerheads undesirable for many purposes, such as washing the hair, because of inadequate flow. Standard shower flow heads can be used and, to achieve conservation, the user can rely upon manual adjustment of the main hot and cold shower water rate valves. This requires a great deal of adjustment and dexterity beyond the ability or concern of most people for water conservation. Some showerheads have a simple on/off valve. However, such showerheads suffer the disadvantage and danger of sudden temperature changes since, when in the off condition, the hydrodynamics of the hot and cold water supplies and their pressure differentials usually result in a water temperature change when next turned on. Since hot and cold line pressures and temperatures change from time to time, such valves cannot be relied upon to provide the same water temperature mix as was present when the showerhead was turned off. When such a showerhead is next turned on, the mixed water may be either scalding hot or freezing cold until the manual valves are adjusted to the desired output temperature. Thus, there remains a need for a shower water supply and control system which minimizes shower water flow, which minimizes temperature changes, and which yet provides an opportunity for a larger rinse flow together with significant water conservation.

SUMMARY OF THE INVENTION

In order to aid in the understanding of this invention, it can be stated in essentially summary form that it is directed to a shower flow controller wherein the shower flow controller has a body with a first adjustable orifice therein and a second orifice in parallel to the first orifice. The second orifice is manually openable and spring-closed so as to be intermittently openable. The second orifice is usually larger than the first so that, when in the flow line to a showerhead, the first orifice provides minimal flow and the second orifice can be manually opened intermittently to provide a larger flow for rinsing.

It is thus an object and advantage of this invention to provide a shower flow controller which has a first minimal flow orifice and a second manually openable spring-closed orifice so that two flow rates are available.

It is a further object and advantage of this invention to provide a shower flow controller which provides an ongoing minimal flow to a showerhead together with a manually openable spring-closed valve which provides a higher flow rate for rinsing off or the like.

It is another object and advantage of this invention to provide a shower flow controller which provides a continuing small flow so as to stabilize temperature in the water stream to the showerhead to conserve water and to help maintain stable temperatures in the water flow.

It is yet another object and advantage of this invention to provide a shower flow controller which has a first orifice which is always open and which is adjustable interiorly of the flow controller body so that it is preset to provide a minimal basic flow rate for water conservation.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an isometric view of a shower system which includes the shower flow controller of this invention.

FIG. 2 is an enlarged center-line section through the shower flow controller of this invention, with parts in elevation.

FIG. 3 is a further enlarged section similar to FIG. 2, with parts in elevation and broken away.

FIG. 4 is an elevational view of the first orifice, as seen generally along line 4—4 of FIG. 3.

FIG. 5 is an exploded fragmentary isometric view of the handle mechanism for operating the second valve.

DESCRIPTION OF THE PREFERRED EMBODIMENT

The shower flow controller of this invention is generally indicated at 10 in FIGS. 1 and 2. FIG. 1 shows a shower compartment wall 12 through which extends shower arm 14. The shower arm 14 is conventionally supplied with water under pressure from both hot and cold water lines. Between the hot and cold water lines and the shower arm 14 are the regular shower valves (not shown). Sometimes these are separate valves with the outflow of each combined in a tee and delivered to shower arm 14. Sometimes the combining of the hot and cold water flows is accomplished in a single valve body with a single handle which controls both the hot and cold water flow. The user adjusts the valves to obtain the desired water temperature and flow rate. The water is delivered out of a showerhead, such as showerhead 16. In accordance with this invention, the shower flow controller 10 is attached between the shower arm sections 14 and 15 to which the showerhead 16 is connected so that the flow controller 10 controls the flow to the showerhead.

As seen in FIG. 2, shower flow controller 10 has a body 18. In domestic installations, the shower arm is threaded with ½ inch pipe threads. Thus, the body 18 has an inlet opening 20 with pipe threads 22 and an outlet opening 24 with pipe threads 26 for respective mounting attachment to the shower arm sections 14 and 15. The showerhead 16 is installed conventionally on the outer end of shower arm section 15. Other attachment means can be used alternatively. Wall 28 extends across the body 18 to separate the inlet and outlet. Wall 28 has a transverse section 30 which has opening 32 therethrough. Valve seat 34 surrounds the opening 32.

Bonnet 36 is attached to the valve body. Bonnet 36 carries valve stem 38 movably mounted therein. The valve stem carries a valve disc 40 on its forward end. When in the closed position shown in FIG. 2, valve disc 40 engages on valve seat 34 to close the opening 32. Spring 42 urges the valve disc toward the closed position. On its outer end, valve stem 38 has threaded section 44 which carries nut 46 thereon. Nut 46 holds hub 48 irrotatable on stem 38. Lever handle 50 is attached to hub 48. As seen in FIGS. 2 and 5, bonnet 36 has a V-notch 52 at its outer end around valve stem 38. Hub 48 has a corresponding V-projection 54 residing in the notch 52. The function of the V-projection and V-notch is such that, when hub 48 is rotated as by moving handle 50, the projection 54 rises in the notch 52 and pulls the valve stem 38 outwardly so that the valve disc 40 is pulled off of valve seat 34 against spring 42. When the handle 50 is released, the spring is sufficiently strong to close the valve disc 40 back against the valve seat 34 and, at the same time, rotate the handle 50 back into the initial position. In other words, the valve disc 40 is self-closing against its seat and can be lifted therefrom by movement of the handle 50. As seen in FIG. 1, the handle 50 carries chain 56 and ring 58 so that the shower user can readily grasp the chain and/or ring and pull thereon to pull down on the handle 50. It is noted that the handle 50 is generally horizontal or perhaps above horizontal in the unactuated position and is pulled down (as shown in dashed lines) for lifting the disc 40 off of its seat 34. It can be appreciated that this structure is a normally closed, manually openable valve. When opened, it permits a substantial flow from the inlet to the outlet of the valve body. Such flow is useful when wetting down and final rinsing of the person of the shower user.

As seen in FIGS. 2 and 3, wall 28 has a threaded opening 60 therein into which is screwed orifice body 62. To accommodate this, orifice body 62 has exterior threads 64 which engage in the threaded opening 60. Orifice body 62 has means to rotate the orifice body into the threaded opening. Any convenient means for engaging the orifice body may be employed. For example, a hexagonal head may be engaged by a hexagonal socket wrench. A hexagonal recess may be engaged by an Allen wrench. In the illustrated embodiment, screwdriver slot 66 is provided. An orifice 68 extends through the orifice body. The opening 60 is positioned to meet two requirements. First, the body 62 must be reached, preferably before installation, to adjust the orifice body for the desired flow rate. Second of all, the orifice body 62 is positioned so that, as it is adjusted in axial position by screwing it into its opening 60, it moves with respect to an obstruction so that flow therethrough is controlled. In the disclosed embodiment, the orifice opening is positioned adjacent disc holder 70. Disc holder 70 is mounted on the end of stem 38, and valve disc 40 is replaceably mounted on the disc holder. It is seen in FIGS. 2 and 3 that the forward end of orifice body 62 is directly adjacent the disc holder 70. As the orifice body is screwed in, the gap 72 between the forward end of the orifice body and the disc holder is reduced in size to reduce flow through orifice 68. The orifice body 62 is preset before installation and, after installation, permits constant but limited flow through the controller 10 as long as its supply is turned on. This constant limited flow is indicated by arrow 74.

The result of the installation of the shower flow controller 10 is the limitation of water flow, as represented by arrow 74, until the manual handle 50 is actuated to provide a larger flow, as indicated by arrow 76, for wetdown and rinsing. The shower flow controller 10 thus achieves several purposes. It conserves water by providing a limited flow during the principal part of the shower. It is advantageous to maintain a low flow during the principal part of the shower for two reasons. First of all, the flow of water, even in the more limited amount, is helpful in the cleansing process during showering. It is also important to note that the continuing limited flow provides temperature stability. The continuing limited flow maintains the flow of hot and cold water to the supply valves and mixing point so that, when the larger flow is turned on, there is little temperature fluctuation. Similarly, when there is a fluctuation in pressure or flow in the supply mains due to other water uses in the system, the change in the mixed flow, even at low flow rate, seems to be decreased. Thus, more temperature stability is achieved as a result of provision of the constant and limited flow.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A shower flow controller comprising:

a valve body, inlet and outlet connections to said valve body for connecting a water supply to said inlet connection and for connecting a showerhead to said outlet connection;

a wall in said valve body separating said inlet connection from said outlet connection, first and second openings through said wall to permit parallel flow of water from said inlet connection to said outlet connection, said second opening being adjustable; and means for closing said first opening and means for opening said first opening, said means for opening said first opening normally closing said first opening until manually actuated and for reclosing said first opening when manual actuation is terminated so that normal limited flow is only through said second opening until said first opening is manually opened and manually retained open.

2. A shower flow controller comprising:

a valve body, inlet and outlet connections to said valve body for connecting a water supply to said inlet connection and for connecting a showerhead to said outlet connection;

a wall in said valve body separating said inlet connection from said outlet connection, said wall having a first opening therethrough, said wall having an orifice body therein, said orifice body having an orifice therethrough, said first opening and said orifice to permit parallel flow of water from said inlet connection to said outlet connection; and means for closing said first opening and means for opening said first opening, said means for opening said first opening normally closing said first opening until manually actuated and for reclosing said first opening when manual actuation is terminated so that normal limited flow is only through said orifice until said first opening is manually opened and manually retained open.

3. The shower flow controller of claim 2 wherein there is a holder within said valve body and said orifice body is adjustable with respect to said holder to adjust the flow through said orifice in said orifice body.

4. The shower flow controller of claim 3 wherein said holder is on said means for closing said first opening.

5. A shower flow controller comprising:

a valve body, inlet and outlet connections to said valve body for connecting a water supply to said inlet connection and for connecting a showerhead to said outlet connection;

a wall in said valve body separating said inlet connection from said outlet connection, first and second openings through said wall to permit parallel flow of water from said inlet connection to said outlet connection; and means for closing said first opening and means for opening said first opening, said means for opening said first opening normally closing said first opening until manually actuated and for reclosing said first opening when manual actuation is terminated so that normal limited flow is only through said second opening until said first opening is manually opened and manually retained open, said means for closing said first opening comprising a valve seat around said first opening and a valve disc movably mounted with respect to said valve seat and spring-urged toward the closed position with respect to said valve seat.

6. The shower flow controller of claim 5 wherein said valve disc is mounted on a valve disc holder and said valve disc holder is mounted on a valve stem so that actuation of said stem moves said valve disc away from said valve seat to open said first opening.

7. The shower flow controller of claim 6 wherein said second opening is in an orifice body and said orifice body is adjustably mounted with respect to said valve disc holder to adjust flow through said second opening.

8. The shower flow controller of claim 6 wherein said valve body has a bonnet thereon and said valve stem has a hub thereon, said hub and said bonnet interengage so that when said hub is rotated said stem is moved to move said valve disc away from said valve seat.

9. The shower flow controller of claim 8 further including a spring urging said stem in a direction to move said valve disc against said valve seat to close said first opening so that manual force must be employed to open and maintain opening of said first opening.

10. The shower flow controller of claim 9 wherein said second opening is adjustable.

11. The shower flow controller of claim 10 wherein said wall separating said inlet connection from said outlet connection has an orifice body therein and said orifice body has an orifice therethrough, said orifice being said second opening.

12. The shower flow controller of claim 11 wherein there is a holder within said valve body and said orifice body is adjustable with respect to said holder to adjust the flow through said orifice in said orifice body.

13. A shower flow controller comprising:

a valve body, an inlet connection on said body for connection to a supply of water under pressure, an outlet connection on said body for connection to a showerhead;

a wall in said body separating said inlet connection from said outlet connection, a first opening in said wall, a valve seat around said first opening, said valve body including a bonnet, a valve stem movably mounted in said bonnet, a valve disc holder mounted on said valve stem, a valve disc mounted on said valve disc holder, said valve stem being movable from a first position where said valve disc engages said valve seat to close said first opening to a second position wherein said valve disc is away from said first opening, resilient means urging said valve disc to its first position, manual means for manually moving said valve disc from its first position to its second position to permit a large flow of water through said valve body; and a second opening through said wall to permit a limited flow of water from said inlet connection to said outlet connection even when said valve disc is in its first position so that a limited water flow is provided to the showerhead for minimal flow during showering.

14. The shower flow controller of claim 13 wherein said second opening is an orifice within an orifice body, said orifice body being mounted in said wall.

15. The shower flow controller of claim 14 wherein said orifice body is adjustably mounted with respect to said wall and is positioned so that adjustment of said orifice body with respect to said wall controls the flow of water through said second opening.

16. The shower flow controller of claim 15 wherein said orifice body lies adjacent said disc holder so that the position of said orifice body with respect to said disc holder controls water flow through said orifice.

17. The shower flow controller of claim 16 wherein said orifice body is threaded through said wall and there is engagement means on said orifice body, said engagement means being accessible through said inlet connection so that said orifice body can be adjusted and positioned within said wall before installation of said shower valve controller.

18. The shower flow controller of claim 17 wherein said engagement means is a screwdriver slot.

19. The shower flow controller of claim 13 further including a manual external handle manually engageable to move said valve disc to its second position.

* * * * *